US006735892B2

(12) United States Patent
Chen

(10) Patent No.: US 6,735,892 B2
(45) Date of Patent: May 18, 2004

(54) ORNAMENT WITH A SNOWING-SCAPE DEVICE

(75) Inventor: Lillian Chen, Taipei (TW)

(73) Assignee: Seagull Decor Co., Ltd., Taipei (TW)

( * ) Notice: Subject to any disclaimer, the term of this patent is extended or adjusted under 35 U.S.C. 154(b) by 0 days.

(21) Appl. No.: 10/219,321

(22) Filed: Aug. 16, 2002

(65) Prior Publication Data

US 2004/0033330 A1 Feb. 19, 2004

(51) Int. Cl.[7] ..... G09F 13/24
(52) U.S. Cl. ..... 40/410; 40/409

(58) Field of Search ..... 428/66.1, 64.1; 40/410, 409, 406

*Primary Examiner*—Alexander S. Thomas
(74) *Attorney, Agent, or Firm*—Troxell Law Office PLLC

(57) ABSTRACT

An ornament with a snowing-scape device including a rotary wheel loaded with water and snow-like flakes. The rotary wheel is mounted in the inner surface of a ring-shaped frame. An outer edge of the rotary wheel is furnished with a gear disc to engage with a transmission assembly so as to drive the rotary wheel to turn the snow-like flakes loaded in the rotary wheel are pushed with the fin plates to a high point, and then the snow-like flakes will fall down slowly to form into a snowing scape to be seen through a transparent window of the ornament.

7 Claims, 8 Drawing Sheets

ORNAMENT WITH A SNOWING-SCAPE DEVICE

BACKGROUND OF THE INVENTION

1. Field of the Invention

This invention relates to an ornament and particularly to an ornament with a snowing-scape device.

2. Description of the Prior Art

In a conventional water-ball ornament, the inner space of a water ball is loaded with a small ornament and filled with water; the opening at the bottom of the glass ball is sealed with a rubber plug; since the water in the glass ball can provide an amplification effect, the ornament in the glass ball can be enlarged considerably.

In a conventional water ball ornament, the glass ball is loaded with snow-like flakes, and then the bottom of the rubber plug is mounted with a transmission assembly, which is engaged with fin plates in the ball; when the fin plates are moving, the water behind the ornament will flow upwards to drive the snow-like flakes to flow upwards; then, the snow-like flakes will fall down slowly from the upper part of the ball so as to provide a snowing scape over the ornament in the ball.

In the aforesaid ball ornament, the transmission assembly inside and outside the ball has to pass through the rubber plug so as to have a motive power transmitted into the ball; in that case, a poor transmission condition would take place between the rubber plug and the transmission assembly; such ornament is merely good for an ornament mounted in a water ball.

SUMMARY OF THE INVENTION

The prime object of the present invention is to provide an ornament with a snowing-scape device, in which a rotary wheel loaded with water and snow-like flakes is mounted on the inner surface of a ring-shaped frame; the outer edge of the rotary wheel has a gear to engage with a transmission assembly so as to have the rotary wheel turned slowly; the snow-like flakes in the rotary wheel are carried to a higher point by means of the fin plates in the rotary wheel; then, they will fall slowly as a result of gravity to provide a snowing scape upon seeing through a transparent window of the ornament.

Another object of the present invention is to provide an ornament with a snowing-scape device, in which the outer edge of the snowing-scape device is covered with an ornament, of which the front side has a transparent window; behind the transparent window, there is a rotary wheel with a transparent window; the rotary member on the edge of the rotary wheel is covered with the ornament; after snow-like flakes are carried to the highest point with the fin plates, they will fall down slowly upon being seen through the transparent window of the ornament to show a snowing scape.

Still another object of the present invention is to provide an ornament with a snowing-scape device, in which the rotary wheel of the snowing-scape device includes a disc and a gear disc; the disc has a recess hollow space and a transparent plate on the bottom thereof; the inner surface of the disc is furnished with a plurality of fin plates arranged regularly; the recess hollow space of the disc is filled with water and snow-like flakes; the round surface of the disc and a gear disc are assembled together closely; the water and the snow-like flakes filled in the hollow space of the rotary wheel will move with the rotary wheel, and after the snow-like flakes are carried to the highest point, they would fall downwards slowly.

A further object of the present invention is to provide an ornament with a snowing-scape device, in which the rotary wheel of the snowing-scape device is mounted on a round bearing surface of a ring-shaped frame; the outer surface of the rotary wheel is supported with a plurality of fixed members so as to have the rotary wheel mounted in the ring-shaped frame; when the gear disc is driven with the transmission assembly, the gear disc will turn steadily.

A still further object of the present invention is to provide an ornament with a snowing-scape device, in which the rotary wheel of the snowing-scape device includes a gear and an idle gear to be engaged with a transmission assembly so as to have a motive power of the transmission assembly to drive the rotary wheel to turn; in that case, the snow-like flakes in the rotary wheel will be carried to the highest point, and then the snow-like flakes will fall downwards slowly as a result of gravity; such repeated turn and falling of the snow-like flakes can provide a snowing scape upon seeing through the transparent window of the ornament.

Yet another object of the present invention is to provide an ornament with a snowing-scape device, in which the outer surface of the disc of the rotary wheel in the snowing-scape device is furnished with a plurality of parallel threads, and then the disc is mounted in a manual ring-shaped frame; both sides of the ring-shaped frame are furnished with two hollow spaces respectively to facilitate a finger to extend therein; as soon as the snowing-scape device is driven with a finger, a snowing scape can be seen through the transparent window of the ornament.

DETAILED DESCRIPTION OF THE PREFERRED EMBODIMENT

Figure 1:
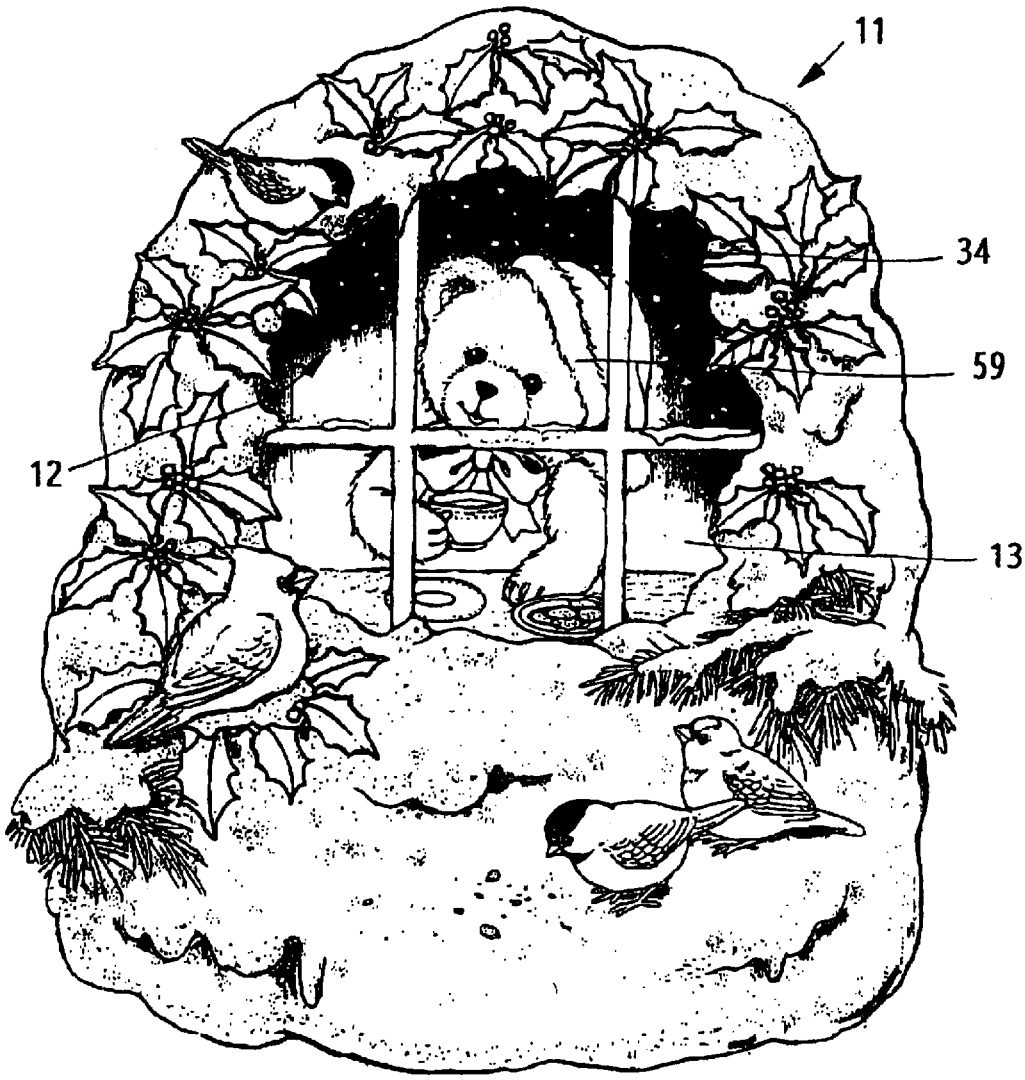
FIG. 1 is a plan view of the present invention, showing the shape of the ornament.
Figure 2:
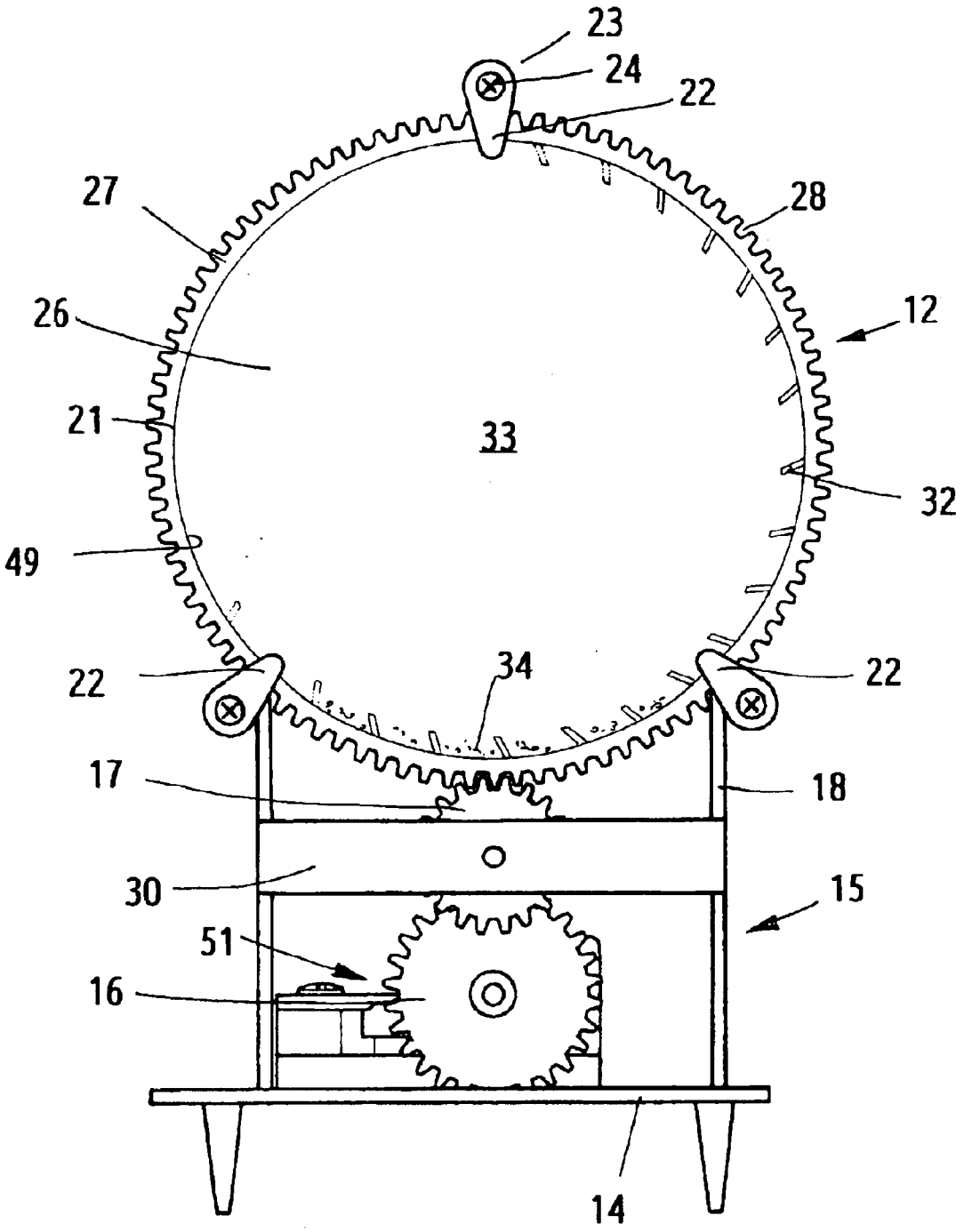
FIG. 2 is a plan view of the present invention, showing the transmission structure of the snowing-scape device.
Figure 3:
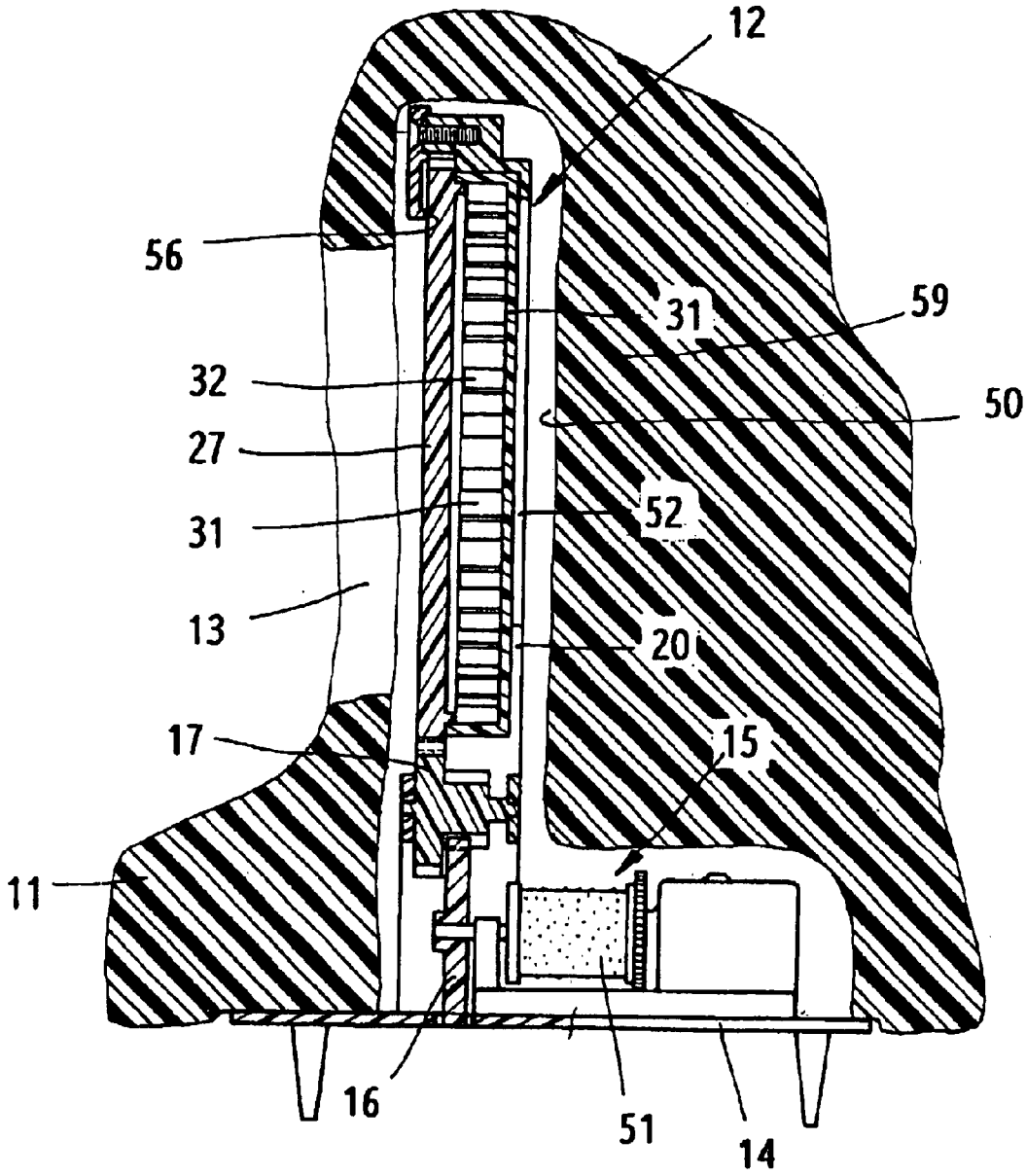
FIG. 3 is sectional view of the present invention, showing the assembled structure between the snowing-scape device and the ornament.
Figure 4:
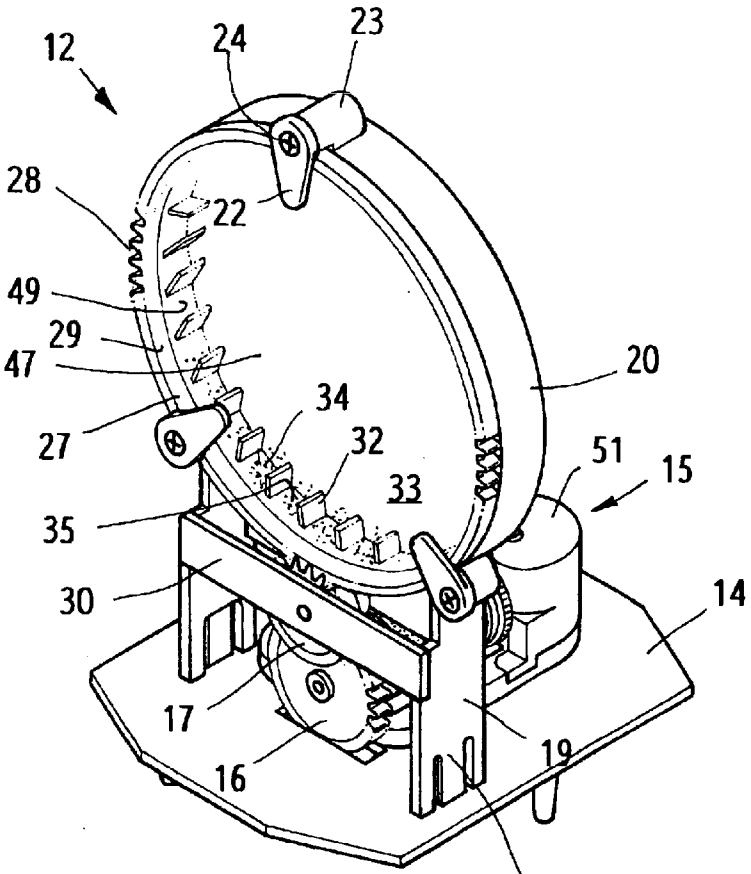
FIG. 4 is a perspective view of the present invention, showing the outer structure of the snowing-scape device.
Figure 5:
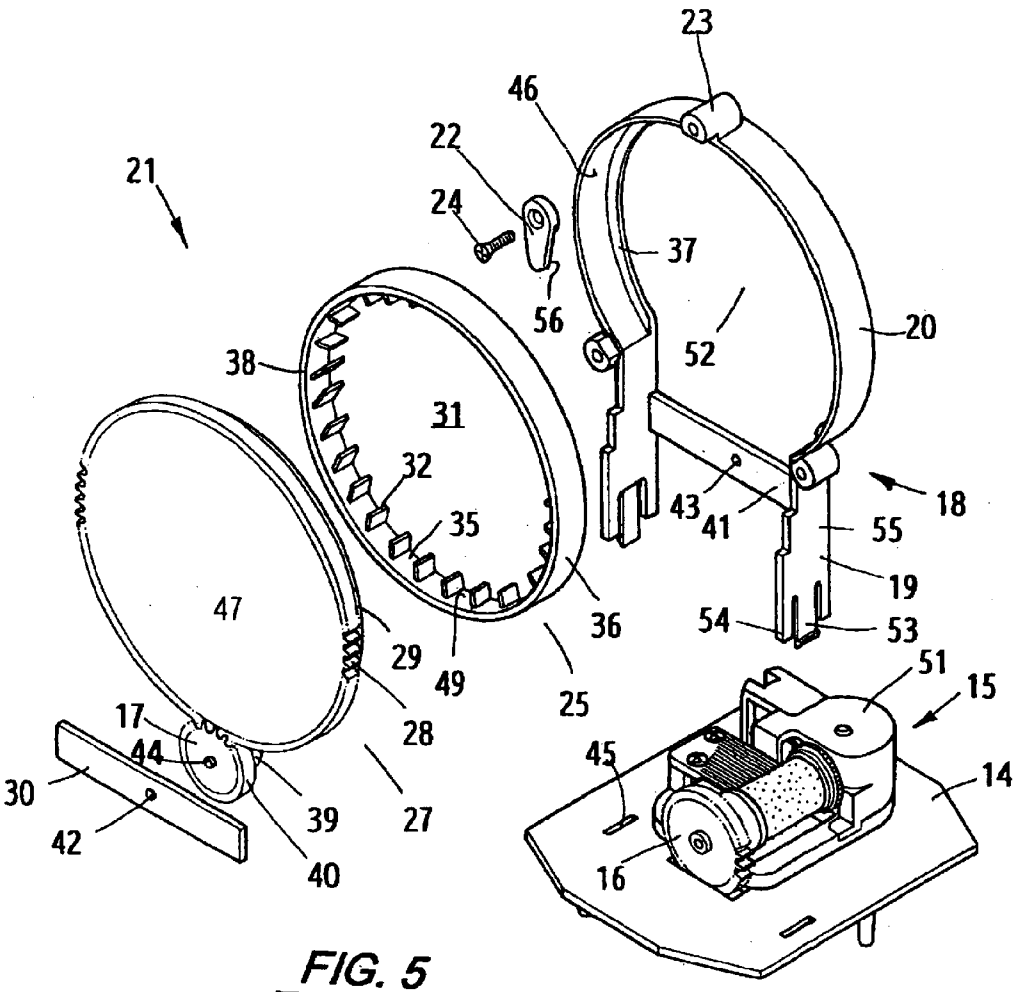
FIG. 5 is a disassembled view of the present invention, showing the assemblies of the snowing-scape device.

This invention relates to an ornament with a snowing-scape device; as showing in FIGS. 1 to 5, the front of the ornament 11 is furnished with a transparent window 13, of which the lower part has a hollow space 50 for mounting a snowing-scape device 12; by means of a transmission assembly 15, a rotary wheel 21 loaded with water and snow flakes 34 can be driven to turn slowly. After the snow flakes 34 are moved to the upper part thereof, they will fall downwards slowly as a result of gravity, and it looks like snow falling in front of the transparent window 13 before the ornament 11.

The snowing-scape device 12 mounted in the hollow space 50 of the ornament 11 includes a transmission assembly 15, a frame 18 and a rotary wheel 21; the transmission assembly 15 includes a music drum 51 mounted on a base plate 14. The bottom of the ornament 11 and the base plate 14 are fixed together; one end of the music drum 51 is connected with a transmission gear 16, and an idle gear 17 so as to have a motive power transmitted to a gear 28 on the rotary wheel 21, and then the rotary wheel 21 will turn slowly. The frame 18 is mounted on the base plate 14; the top of the frame 18 is mounted with a ring-shaped frame 20, of which the inner surface is mounted with a rotary wheel 21; one side of the rotary wheel 21 has an idle gear 17 engaged with a gear 28. When the music drum 51 turns, the transmission gear 16 can provide motive power via the idle gear 17, and the gear 28 of the rotary wheel 21; then, rotary wheel 21 will turn slowly along the inner surface of the ring-shaped frame 20.

The base plate 14 and the frame 18 are assembled together, and the lower part of the ring-shaped frame 20 is furnished with two symmetrical and parallel plate members 55, of which the lower ends are furnished with two hooks 53 respectively; the size of the hooks 53 is slightly smaller than that of the rectangular slots 45 in the base plate 14. Both sides of each hook 53 are furnished with two symmetrical check plates 54 respectively. When the fixed plates 19 are mounted into the rectangular slots 45 of the base plate 14, the hooks 53 can be plugged into the rectangular slots 45 to engage with the bottom surface of the base plate 14 flexibly; simultaneously, the check plates 54 will fix against the top surface of the bas plate 14 so as to have the frame 18 fastened to the base plate 14.

Two symmetrical support plates 41 and 30 are mounted between the two fixed plates 19 of the frame 18; both support plates 41 and 30 are furnished with two round holes 43 and 42 respectively for receiving the spindle 44 of the idle gear 17, which is engaged with the rotary wheel 21 and the gear 28; the idle gear 17 is engaged with the transmission assembly 15 so as to have the motive power of the transmission assembly 15 transmitted to the rotary wheel 21.

The ring-shaped frame 20 on the frame 18 is substantially a ring-shaped plate, of which the height and diameter are so designed as to fit the thickness of the rotary wheel 21 and the diameter of the outer surface 36. The inner surface 52 of the ring-shaped frame 20 has a round bearing surface 46 and a ring-shaped edge 37. The diameter of the bearing surface 46 is designed to receive the outer surface 36 of the rotary wheel 21 only, and the play between them is merely to enable the rotary wheel 21 to rotate freely. The ring-shaped edge 37 inside the round bearing surface 46 is used for limiting the rotary wheel 21 to move within the round bearing surface 46. The outer surface of the ring-shaped frame 20 is furnished with three screw bars 23 arranged at a symmetrical triangle position; each screw bar 23 is mounted with a fixed member 22 before a screw 24 being mounted thereto. The fixed member 22 should be mounted at one end of the screw bar 23 after the rotary wheel 21 being mounted in the inner surface 52 of the ring-shaped frame 20; a salient point 56 on the tail end of the fixed member 22 is used for pushing against the rotary wheel 21 so as to reduce the resistance of the rotary wheel 21 and to prevent the rotary wheel 21 separating from the ring-shaped frame 20.

The rotary wheel 21 mounted on the inner surface 52 of the ring-shaped frame 20 includes a disc 25, a gear disc 27, snow-like flakes 34 and water 33. The outer surface 36 of the disc 25 is so designed as to fit with the diameter and height of the round bearing surface 46 of the ring-shaped frame 20. The disc 25 has an open ring-shaped surface 38 and a close-transparent plate 31; the open ring-shaped surface 38 and the gear disc 27 are in close and hermetic contact. The inner surface 49 of the rotary wheel 21 is furnished with a plurality of fin plates 32 arranged regularly; a suitable separation space 35 is set among snow-likes flakes 34; every snow-like flake 34 has a given sloping angle in the rotation direction. A hollow space 26 is furnished between the inner surface 49 and the transparent panel 31. Before the disc 25 and the gear disc 27 being assembled together, a plurality of snow-like flakes 34 and water 33 must be loaded in the hollow space 26; the gear disc 27 is to be mounted over the disc 25, and they are sealed together by means of supersonic wave; the snow-like flakes 34 and the water 33 are sealed inside the hollow space 26 of the disc 25.

Figure 6:
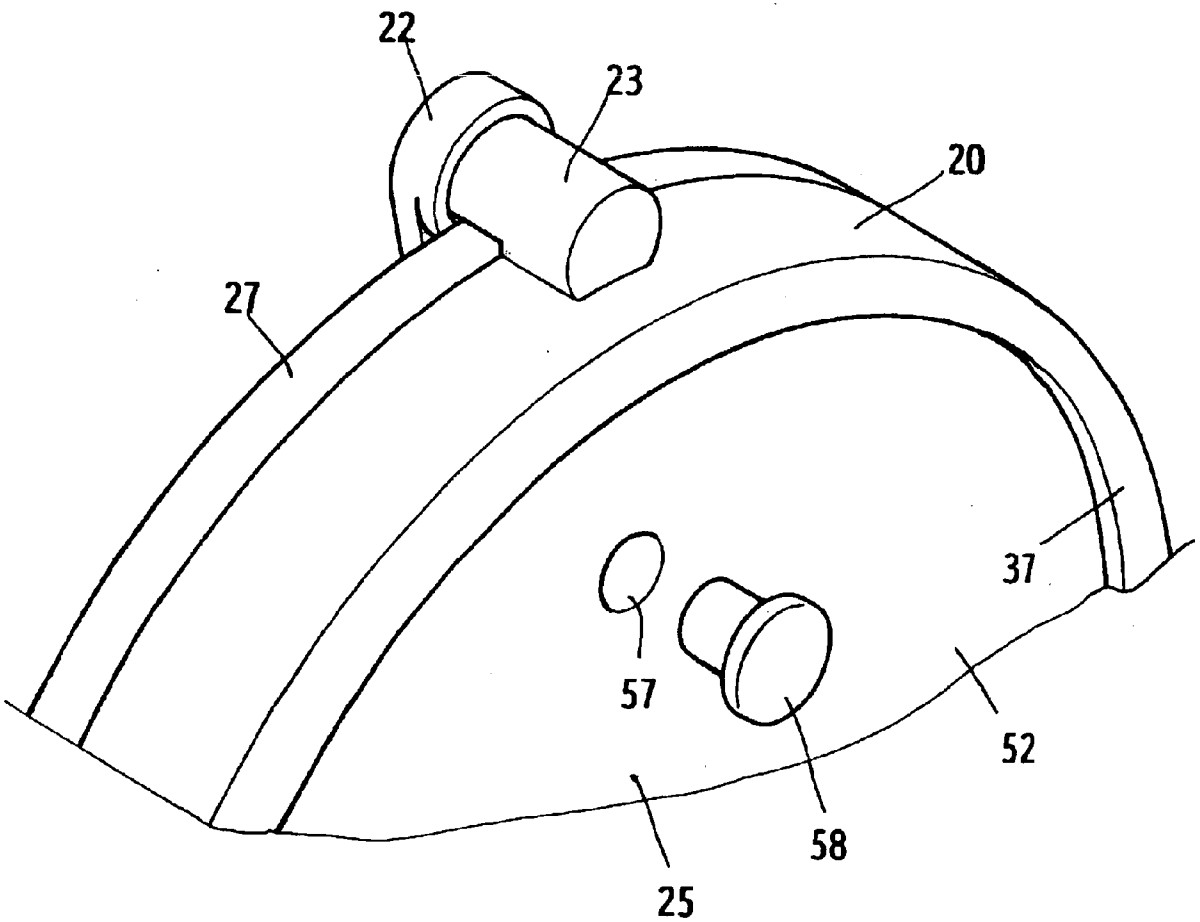
FIG. 6 is a sectional view of the present invention, showing the water-refilling hole structure of the rotary wheel.

As shown in FIG. 6, the water 33 and the snow-like flakes 34 are sealed in the hollow space 26 in the disc 25; a round hole 57 is furnished in the transparent panel 31 of the disc 25, and it nears the fin plates 32. The contact surfaces between the disc 25 and the gear discs 27 are first sealed together by means of supersonic wave to form into a rotary wheel 21. The water 33 and the snow-like flakes 34 are to be filled into the hollow space 26 via a filling hose and the round hole 57 in the transparent panel 31, and then the round hole 57 is closed with a plug 58 so as to prevent the water 33 and snow-like flakes 34 from leaking.

The gear disc 27 are assembled together with the disc 25 and the ring-shaped surface 38, and the center thereof is furnished with a transparent panel 47, of which the edge is furnished with a ring-shaped gear 28. After the rotary wheel 21 is mounted on the ring-shaped frame 20, the ring-shaped gear 28 of the rotary wheel 21 will engage with the idle gear 17; then, the transparent panel 47 of the gear disc 27 has one side furnished with a seal ring 29 to face the disc 25; the seal ring 29 is so designed as to fit with the inner size of the ring-shaped surface 38; after the two parts are mounted together, they are welded together by means of supersonic wave.

The rotary wheel 21 filled with water 33 and snow-like flakes 34 is mounted in the round bearing surface 46 of the ring-shaped frame 20; then, the screw bars 23 on the edge of the ring-shaped frame 20 are mounted with fixed members 22 and screws 24 respectively; the rotary wheel 21 is then fastened in place by means of the ring-shaped edge 37 of the ring-shaped frame 20 and the fixed members 22. As soon as the motive power of the transmission assembly 15 is transmitted to the gear 28 of the rotary wheel 21, the rotary wheel 21 will turn slowly along the round bearing surface 46 of the ring-shaped frame 20.

The snow-like flakes 34 in the hollow space 26 of the rotary wheel 21 will be carried with the rotary wheel 21 to the highest point as a result of gravity; then, the snow-like flakes 34 will fall down as a result of the weight thereof being greater than the centrifugal force; in that case, the snow-like flakes 34 in the water of the hollow space 26 would fall down slowly like a real snowing-scape.

The snowing-scape device 12 is mounted in a hollow space 50 of the ornament 11; the bottom of the ornament 11 is fastened on the base plate 14. The transparent window 13 of the ornament 11 is mounted closely to the transparent panel 47 of the rotary wheel 21. Since the size of the transparent window 13 of the ornament 11 is smaller than that of the rotary wheel 21, the ornament on the outer edge of the transparent window 13 can cover the outer edge of the transparent panel 47; since the transparent panel 47 is similar to an inner glass of the transparent window 13, a person can see an ornament member or a cubic ornamental surface 59.

When the transmission assembly 15 drives the rotary wheel 21 to turn slowly, the snow-like flakes 34 will fall into the separation space 35 among the fin plates 32 of the rotary wheel 21 as a result of gravity; after the snow-like flakes 34 are moved with the fin plates 32 to the highest point, the snow-like flakes 34 will fall down as a result of the gravity thereof; then, they are scattered in the hollow space 26; such condition will occur repeatedly, and therefore it can be seen through the transparent window 13 of the ornament 11 a snowing scape.

Figure 7:
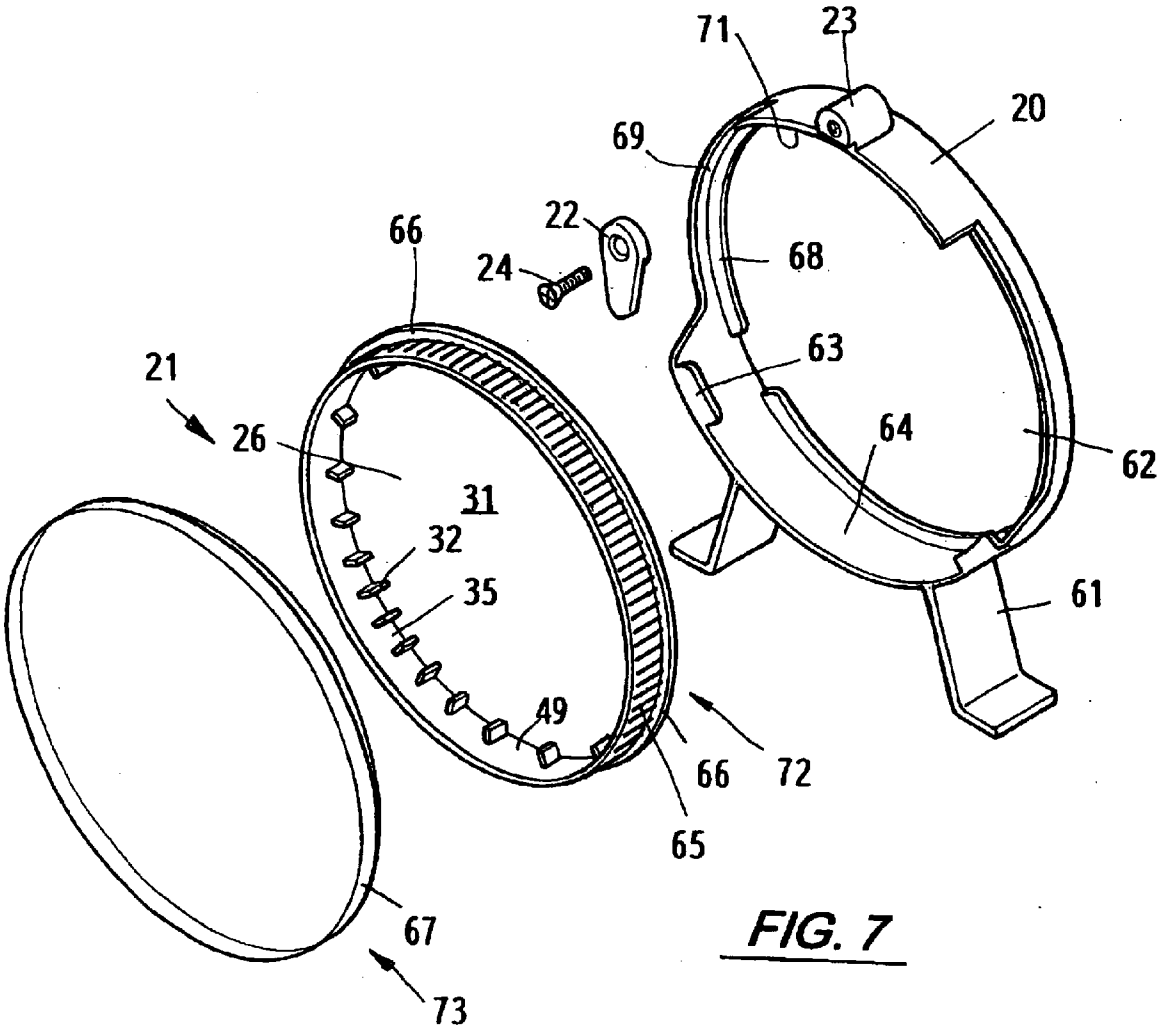
FIG. 7 is a disassembled view of the present invention, showing the relation among the assemblies of the snowing-scape device.
Figure 8:
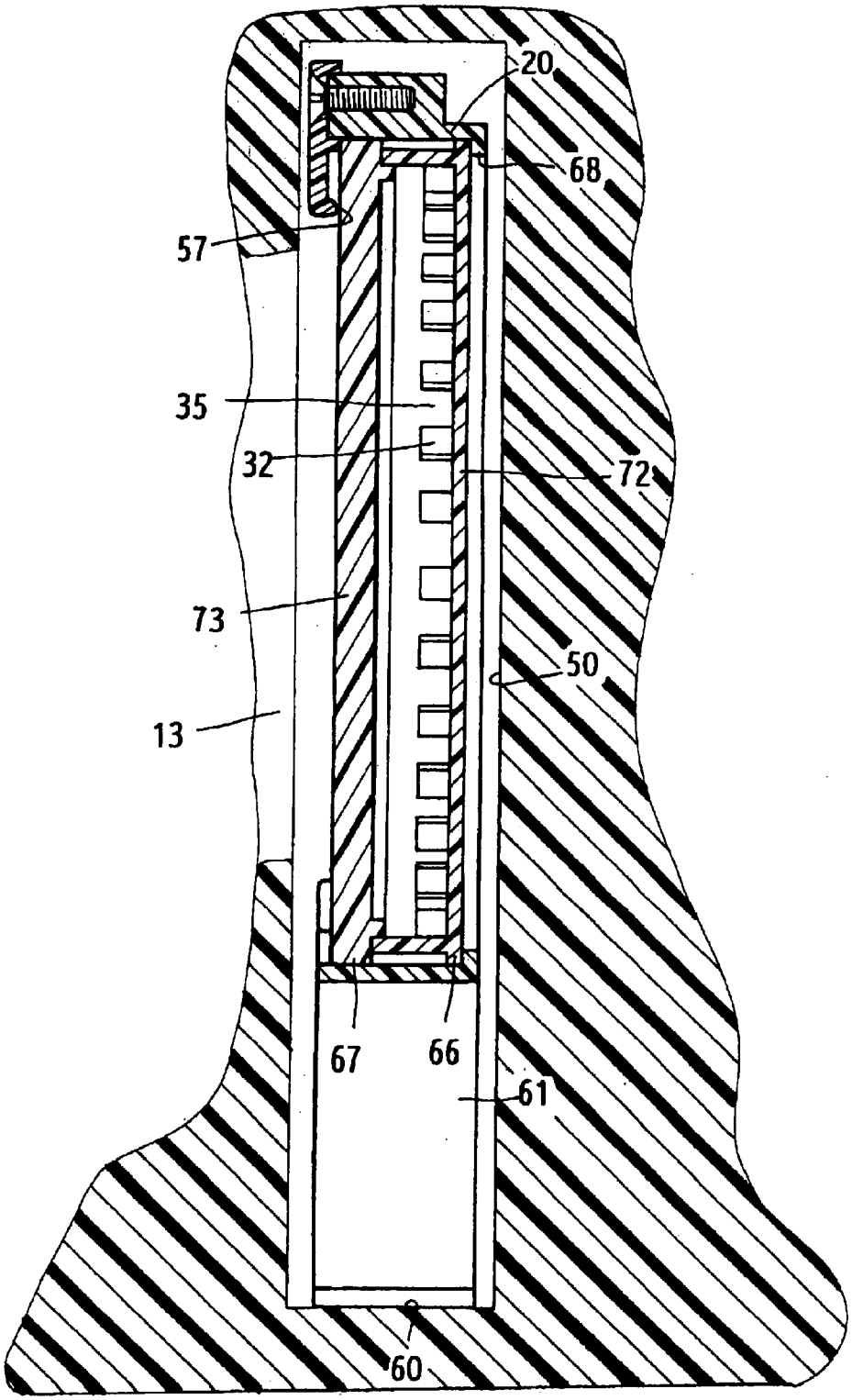
FIG. 8 is a sectional view of the present invention, showing the manual-operation snowing-scape device mounted in an ornament.

As shown in FIGS. 1, 7 and 8, the manual rotary wheel 21 mounted on the ring-shaped frame 20 is to be put in place through the window of the ornament 11; the lower part of the ring-shaped frame 20 is furnished with two symmetrical frame plates 61, which facilitate the ring-shaped frame 20 to be mounted on the platform 60 in the hollow space 50. The outer surface of the disc 25 of the rotary wheel 21 is furnished with parallel threads 65; a person's finger can extend into the window beside the ornament 11 to touch and push the parallel threads 65 so as to drive the rotary wheel 21 to turn; then, the fin plates 32 of the rotary wheel 21 will push the snow-like flakes to the highest point, and the snow-like flakes 34 with different weight will fall down at different positions as a result of the weight thereof, i.e., being scattered and falling slowly in the hollow space 26; it looks like a real snowing-scape through the transparent window 13 of the ornament 11.

The snowing-scape device 12 put in place through the window beside the ornament 11 includes a ring-shaped frame 20 and a rotary wheel 21. The inner surface of the ring-shaped frame 20 is furnished with a round edge 68 and a round bearing surface 69, which are designed to fit in the thickness of the rotary wheel 21 so as to have the rotary wheel 21 limited in the round bearing surface 69 upon turning. Both sides of the ring-shaped frame 20 are furnished with symmetrical hollow spaces 62. The outer edge of the lower round surface 64 is furnished with two symmetrical check plates 63. The outer edge of the upper round surface 71 is furnished with screw bars 23; the round bearing surface 69 is used for mounting the rotary wheel 21. The inner edge of the rotary wheel 21 is to be stopped with the round edge 68, while the outer edge thereof is stopped with the check plates 63 and the fixed members 22 on the screw bars 23 arranged at a triangle position so as to limit the rotary wheel 21 within the hollow space of the ring-shaped frame 20 without becoming derailed.

The rotary wheel 21 mounted in the ring-shaped frame 20 includes a manual-operation disc 72, a disc lid 73, water 33 and snow-like flakes 34; the outer edge of the manual-operation disc 72 is furnished with parallel threads 65, of which the open ring surface is to be mounted with a disc lid 73; the outer round edge 66 of the parallel threads 65 is slightly bigger than the diameter of the parallel threads 65. After the rotary wheel 21 is mounted in the ring-shaped frame 20, the surface of the round edge 66 will be in contact with the round bearing surface 69. The inner surface of the manual-operation disc 72 is furnished with a plurality of fin plates 32 arranged regularly; a separation space 35 is furnished between two fin plates 32 for receiving snow-like flakes 34. When the rotary wheel 21 turns, the snow-like flakes 34 will be carried with the fin plates 32 to the highest point, and then they would scatter and fall down slowly.

The disc lid 73 of the rotary wheel 21 is made of a transparent material, and it has a round edge 67 with a diameter equal to that of the round edge 66. After the disc lid 73 and the manual-operation disc 72 are in contact with each other and welded together by means of supersonic wave, the outer surface of the rotary wheel 21 will have the round edges 66 and 67 with an equal diameter mounted on the round surface 64 of the ring-shaped frame 20. The parallel threads 65 extend across both sides of the ornament 11 via the hollow space 62 of the ring-shaped frame 20. The manual-operation disc 72 and the disc lid 73 are made of a transparent material; after the hollow space 26 is filled with water, the transparent panel 47, the hollow space 26 and the transparent panel 31 are formed into one transparent panel, which is then mounted in the hollow space 50 of the ornament 11; the assemblies outside the transparent panel are all covered with the ornament 11 if one watches through the front transparent window 13.

The ornament 11 mounted with the snowing-scape device 12 would not move, when it is not operated with finger. As soon as a person's finger extends into the hollow space on both sides of the ornament 11 to push the parallel threads 65 of the rotary wheel 21, the snow-like flakes 34 in the rotary wheel 21 will be carried upwards with the fin plates 32. After the snow-like flakes 34 are elevated to the highest point, they will fall down slowly as a result gravity thereof; since the rotary wheel 21 is turned continuously, the snow-like flakes 34 will fall downwards continuously; therefore, it looks like a real snowing scape to be seen through the transparent window 13 of the ornament 11.

According to the aforesaid description of the embodiment of the present invention, the features and structure of the present invention have been disclosed completely; it is apparent that the present invention has provided obvious improvement, which is never anticipated and achieved by any person in the field; therefore, the structure thereof is deemed unique.

What is claimed is:

1. An ornament with a snowing-scape device comprising:

an ornament furnished with a transparent window in front thereof, an inner hollow space of said transparent window mounted with a snowing-scape device;

said snowing-scape device including:

a transmission assembly mounted on a base plate of said ornament transmitting a motive power to gears of a rotary wheel via transmission gear;

a rotary wheel;

a frame, of which a lower part is connected with two parallel fixed plates and a base plate, while an upper part thereof has a ring-shaped frame receiving said rotary wheel in an inner space thereof; an outer surface of said rotary wheel being in contact with and limited on a round bearing surface of said ring-shaped frame;

said rotary wheel mounted on said bearing surface of said ring-shaped frame having a rotary wheel gear on outer surface thereof, and said rotary wheel gear engaged with an idle gear on lower side thereof; said idle gear engaged with a gear of said transmission assembly; inner surface of said rotary wheel having a plurality of fin plates arranged regularly, and space between said fin plates filled with water and artificial snow flakes.

2. The ornament with a snowing-scape device as claimed in claim 1, wherein said round bearing surface of said ring-shaped frame has a round edge, and outer edge of said ring-shaped frame furnished with symmetrical screw bars;

after said rotary wheel being mounted on said round bearing surface, said round edge thereof being in contact with edge of said rotary wheel, while outer side thereof being fastened in place with a plurality of fixed members so as to limit said rotary wheel in a hollow space of said ring-shaped frame.

3. The ornament with a snowing-scape device as claimed in claim 1, wherein said snowing-scape device includes a disc and a gear disc; center of said gear disc mounted with a transparent panel, and inner surface of said disc furnished with a plurality of fin plates arranged regularly; a center panel being substantially a transparent panel; water and artificial snow flakes filled in a hollow space between said two transparent panels.

4. An ornament with a snowing-scape device comprising:

an ornament having a transparent window in front thereof; inner hollow space of said transparent window mounted with a snowing-scape device;

a snowing-scape device including:

a frame mounted on a platform in an ornament by means of a frame plate; upper part of said frame plate furnished with a ring-shaped frame for mounting a rotary wheel therein; outer surface of said rotary wheel closely attached and limited on a bearing surface of said ring-shaped frame upon turning;

a rotary wheel mounted on said bearing surface in said ring-shaped frame being furnished with parallel threads; both sides of said parallel threads furnished with round edges having a larger diameter; inner surface of said rotary wheel furnished with a plurality of fin plates arranged regularly; inner hollow space thereof filled with water and artificial snow flakes.

5. The ornament with a snowing-scape device as claimed in claim 4, wherein snowing-scape device has a frame, and upper part of said frame plate mounted with a ring-shaped frame, of which both sides furnished with through separation spaces; both sides thereof furnished with two hollow spaces being opposite both sides of said ornament so as to facilitate a person finger to push said rotary wheel to turn.

6. The ornament with a snowing-scape device as claimed in claim 4, wherein said rotary wheel of said snowing-scape device includes a manual-operation disc and a disc lid; outer surface of said manual-operation disc furnished with parallel threads, and outer edge thereof having a round edge with a larger diameter; outer edge of said disc lid also having said same diameter; said rotary wheel mounted on inner surface of said ring-shaped frame by means of said large-diameter edges of said parallel threads.

7. The ornament with a snowing-scape device as claimed in claim 4, wherein inner surface of said manual-operation disc of said rotary wheel is furnished with a plurality of fin plates arranged regularly; said manual-operation disc and said disc lid forming said rotary wheel, of which the hollow space filled with water and a plurality of artificial snow flakes.

* * * * *